US009269300B2

(12) United States Patent
Yang et al.

(10) Patent No.: US 9,269,300 B2
(45) Date of Patent: Feb. 23, 2016

(54) PIXEL DRIVING CIRCUIT AND METHOD, ARRAY SUBSTRATE, AND DISPLAY APPARATUS

(71) Applicant: Beijing BOE Optoelectronics Technology Co., Ltd., Beijing (CN)

(72) Inventors: Shengji Yang, Beijing (CN); Junwei Wu, Beijing (CN); Haisheng Wang, Beijing (CN); Yingming Liu, Beijing (CN)

(73) Assignee: BEIJING BOE OPTOELECTRONICS TECHNOLOGY CO., Ltd., Beijing (CN)

( * ) Notice: Subject to any disclaimer, the term of this patent is extended or adjusted under 35 U.S.C. 154(b) by 0 days.

(21) Appl. No.: 13/995,910

(22) PCT Filed: Dec. 4, 2012

(86) PCT No.: PCT/CN2012/085783

§ 371 (c)(1),
(2) Date: Jun. 19, 2013

(87) PCT Pub. No.: WO2013/166827

PCT Pub. Date: Nov. 14, 2013

(65) Prior Publication Data

US 2014/0118231 A1 May 1, 2014

(30) Foreign Application Priority Data

May 10, 2012 (CN) ..... 2012 1 0145708

(51) Int. Cl.
*G09G 3/30* (2006.01)
*G09G 3/32* (2006.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/12–3/14; G09G 3/30–3/3291
USPC ..... 345/36, 45–46, 76–86
See application file for complete search history.

(56) References Cited

U.S. PATENT DOCUMENTS

2005/0052367 A1* 3/2005 Miyazawa ..... 345/76
2006/0044235 A1* 3/2006 Lee et al. ..... 345/82
(Continued)

FOREIGN PATENT DOCUMENTS

CN 101019166 A 8/2007
CN 101339737 A 1/2009
(Continued)

OTHER PUBLICATIONS

International Search Report (Chinese language) issued by the International Searching Authority, rendered Mar. 14, 2013, 13 pages.
(Continued)

*Primary Examiner* — Sanghyuk Park

(57) ABSTRACT

A pixel driving circuit and method, an array substrate, and a display apparatus, wherein the pixel driving circuit comprises a data line, a first scan line, a signal control line, a light emitting device, a storage capacitor, a driving transistor and four switching transistors. The pixel driving circuit can avoid the influence on a driving current of an OLED caused by threshold voltage drift of a driving transistor, and improve the uniformity of a displayed image.

13 Claims, 7 Drawing Sheets

(52) U.S. Cl.
CPC ..... *G09G2300/0842* (2013.01); *G09G 2300/0861* (2013.01); *G09G 2310/0251* (2013.01); *G09G 2310/0262* (2013.01); *G09G 2320/045* (2013.01)

(56) References Cited

U.S. PATENT DOCUMENTS

| | | | | |
|---|---|---|---|---|
| 2006/0103606 | A1* | 5/2006 | Ahn et al. | 345/76 |
| 2007/0210993 | A1* | 9/2007 | Murakata et al. | 345/76 |
| 2007/0290973 | A1 | 12/2007 | Wei | |
| 2008/0030439 | A1* | 2/2008 | Shin | 345/82 |
| 2008/0170008 | A1* | 7/2008 | Kim | 345/76 |
| 2008/0316150 | A1* | 12/2008 | Lee et al. | 345/76 |
| 2010/0156762 | A1 | 6/2010 | Choi | |
| 2011/0090208 | A1 | 4/2011 | Long et al. | |
| 2011/0164016 | A1* | 7/2011 | Kang et al. | 345/211 |
| 2011/0193768 | A1* | 8/2011 | Choi et al. | 345/76 |
| 2011/0216056 | A1* | 9/2011 | Yoo et al. | 345/212 |
| 2011/0279433 | A1* | 11/2011 | Ryu | 345/211 |
| 2012/0147070 | A1* | 6/2012 | Segawa et al. | 345/694 |
| 2012/0176426 | A1* | 7/2012 | Ono | 345/691 |
| 2014/0118231 | A1 | 5/2014 | Yang et al. | |

FOREIGN PATENT DOCUMENTS

| | | | |
|---|---|---|---|
| CN | 201266473 | Y | 7/2009 |
| CN | 101996579 | A | 3/2011 |
| CN | 102034426 | A | 4/2011 |
| CN | 202067514 | U | 12/2011 |
| CN | 102708819 | A | 10/2012 |
| WO | 2004088626 | A1 | 10/2004 |
| WO | 2004097782 | A1 | 11/2004 |

OTHER PUBLICATIONS

The State Intellectual Property Office of the People's Republic of China ("SIPO") (Chinese Language) Office Action issued on Oct. 11, 2013 by SIPO in Chinese Patent Application No. 201210145708.7; three (3) pages.

English Translation of The State Intellectual Property Office of the People's Republic of China ("SIPO") Office Action issued on Oct. 11, 2013 by SIPO in Chinese Patent Application No. 201210145708.7; three (3) pages.

English abstract of CN101996579(A) listed above, 13 pages.

English abstract of CN101019166(A) listed above, 51 pages.

English abstract of CN101339737(A) listed above, 16 pages.

English abstract of CN201266473(Y) listed above, 16 pages.

English abstract of CN102034426(A) listed above, 18 pages.

English abstract of CN202067514(U) listed above, 27 pages.

English abstract of CN102708819(A) listed above, 17 pages.

International Preliminary Report on Patentability, in PCT Application No. PCT/CN2012/085783, dated Nov. 11, 2014, 8 pages.

* cited by examiner

PIXEL DRIVING CIRCUIT AND METHOD, ARRAY SUBSTRATE, AND DISPLAY APPARATUS

CROSS REFERENCE TO RELATED APPLICATIONS

This application is based on International Application No. PCT/CN2012/085783 filed on Dec. 4, 2012, which claims priority to Chinese National Application No. 201210145708.7, filed on May 10, 2012, the contents of which are incorporated herein by reference.

TECHNICAL FIELD OF THE DISCLOSURE

The present disclosure relates to display techniques, and particularly, to a pixel driving circuit and method, an array substrate, and a display apparatus.

BACKGROUND

At present, Active Matrix Organic Light Emitting Diode (AMOLED) display is a focus topic in panel display research. Compared to Liquid Crystal Display, Organic Light Emitting Diode (OLED) has the advantages of low power consumption, low manufacture cost, self illumination, wide view angle and rapid response, etc., and begins to replace conventional LCD display screens in display fields, such as mobile phone, PDA (Personal Digital Assistant), and digital camera, etc. Pixel driving circuit design is a core technique of AMOLED display, and has important research significance.

Different from that Thin Film Transistor Liquid Crystal Display (TFT-LCD) performs luminance control by using a stable voltage, OLED is a current-driven device and requires a stable current to perform luminance control. Due to manufacture process and device aging, etc., in an existing driving circuit comprising two transistors T1 and T2 and a storage capacitor C1 (please refer to FIG. 1), a driving current $I_{OLED}$ is generated by applying a voltage $V_{data}$ supplied from a data line on a saturation region of a driving transistor (DTFT). The driving current drives OLED to emit light, and can be calculated as: $I_{OLED}=K(V_{GS}-V_{th})^2$, wherein $V_{GS}$ is a voltage across a gate and a source of the driving transistor, and $V_{th}$ is a threshold voltage of the driving transistor. The threshold voltages $V_{th}$ of respective driving TFTs of pixels (that is, T2 in FIG. 1) are not uniform due to manufacture process and device aging, etc., thereby the currents flowing through respective OLEDs in pixels changing from one to another, and thus display quality of a whole image is affected.

SUMMARY

Embodiments of the present disclosure provide a pixel driving circuit and method, an array substrate, and a display apparatus, capable of avoiding the influence on a driving current of an OLED caused by threshold voltage drift of a driving transistor and thus improving the uniformity of a displayed image.

Embodiments of the present disclosure adopt the following technical solutions.

According to one aspect of the present disclosure, there is provided pixel driving circuit, comprising: a data line, a first scan line, a signal control line, a light emitting device, a storage capacitor, a driving transistor, a first switching transistor, a second switching transistor, a third switching transistor, and a fourth switching transistor; the first switching transistor having a gate connected to the signal control line, a source connected to a first level terminal, and a drain connected to a first terminal of the storage capacitor; the second switching transistor having a gate connected to the first scan line, a source connected to a low level, and a drain connected to a second terminal of the storage capacitor; the third switching transistor having a gate connected to the first scan line, and a source connected to the second terminal of the storage capacitor; the fourth switching transistor having a gate connected to the first scan line, a source connected to the data line, and a drain connected to a drain of the third switching transistor; the driving transistor having a gate connected to the drain of the fourth switching transistor, and a source connected to the first terminal of the storage capacitor; one terminal of the light emitting device being connected to the drain of the driving transistor, and the other terminal being connected to a second level terminal.

According to another aspect of the present disclosure, there is provided a driving method for the above described pixel driving circuit, comprising: in a first period, turning on the first switching transistor, the second switching transistor and the fourth switching transistor, turning off the third switching transistor, and the first level terminal charging the storage capacitor; in a second period, turning on the second switching transistor and the fourth switching transistor, turning off the first switching transistor and the third switching transistor, and the storage capacitor discharging till a voltage difference between the gate and source of the driving transistor is equal to a threshold voltage of the driving transistor; and in a third period, turning on the first switching transistor and the third switching transistor, turning off the second switching transistor and the fourth switching transistor, and the first level terminal and the second level terminal applying a turn-on signal on the light emitting device.

According to yet another aspect of the present disclosure, there is provided an array substrate comprising the above described pixel driving circuit.

According to still another aspect of the present disclosure, there is provided a display apparatus comprising the above described array substrate.

With the pixel driving circuit and method, the array substrate, and the display apparatus provided in the embodiments of the present disclosure, the influence on an OLED driving current caused by threshold voltage drift of a driving transistor can be removed by voltage compensation and thus the uniformity of the display image can be improved.

BRIEF DESCRIPTION OF THE DRAWINGS

In order to explain the technical solutions in the embodiments of the present disclosure or in the prior art more clearly, accompanying drawings required for describing the embodiments of the present disclosure or the prior art will be introduced. Obviously, the accompanying drawings below are only some embodiments of the present disclosure, and based on the accompanying drawings, other accompanying drawings can be obtained by those skilled in the art without paying inventive labor.

DETAILED DESCRIPTION

Descriptions will be made clearly and thoroughly for the technical solutions in the embodiments of the present disclosure below, taken in conjunction with the accompanying drawings of the embodiments of the present disclosure. Obviously, the described embodiments are only some but not all of the embodiments of the present disclosure. Other embodiments obtained by those skilled in the art based on the described embodiments without paying inventive labor shall belong to the scope sought for protection in the present disclosure.

Switching transistors and driving transistor adopted in the embodiments of the present disclosure may be Thin Film Transistors, Field Effect Transistors, or other devices with the same characteristics. Since a drain and a source of a switching transistor are symmetric herein, the drain and the source can be exchanged. In the embodiments of the present disclosure, in order to distinguish two terminals other than a gate of a transistor, one terminal is called a source and the other terminal is called a drain. According to the symbols in the accompanying drawings, it is prescribed that an intermediate terminal of the transistor is the gate, a signal input terminal is the source and a signal output terminal is the drain. In addition, the switching transistors adopted in the embodiments of the present disclosure include P type switching transistors and N type switching transistors, wherein the P type switching transistor is turned on when the gate thereof is at a low level and turned off when the gate thereof is at a high level; and the N type switching transistor is turned on when the gate thereof is at the high level and turned off when the gate thereof is at the low level. In addition, in the description of the present application, when an element is "connected" to another element, the element can be connected to said another element directly, or one or more elements can be inserted between the element and said another element. On the contrary, when an element is "connected directly" to another element, there is no intermediate element.

Figure 1:
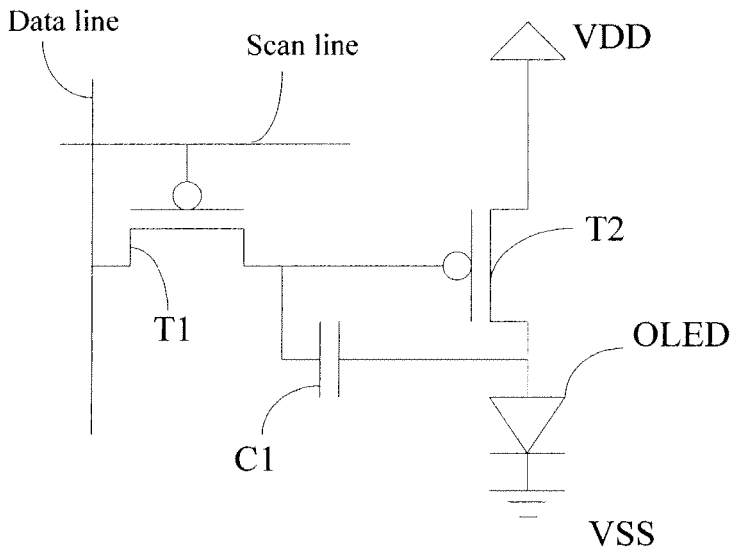
FIG. 1 is a schematic structure diagram of a pixel driving circuit provided in the prior art.
Figure 2:
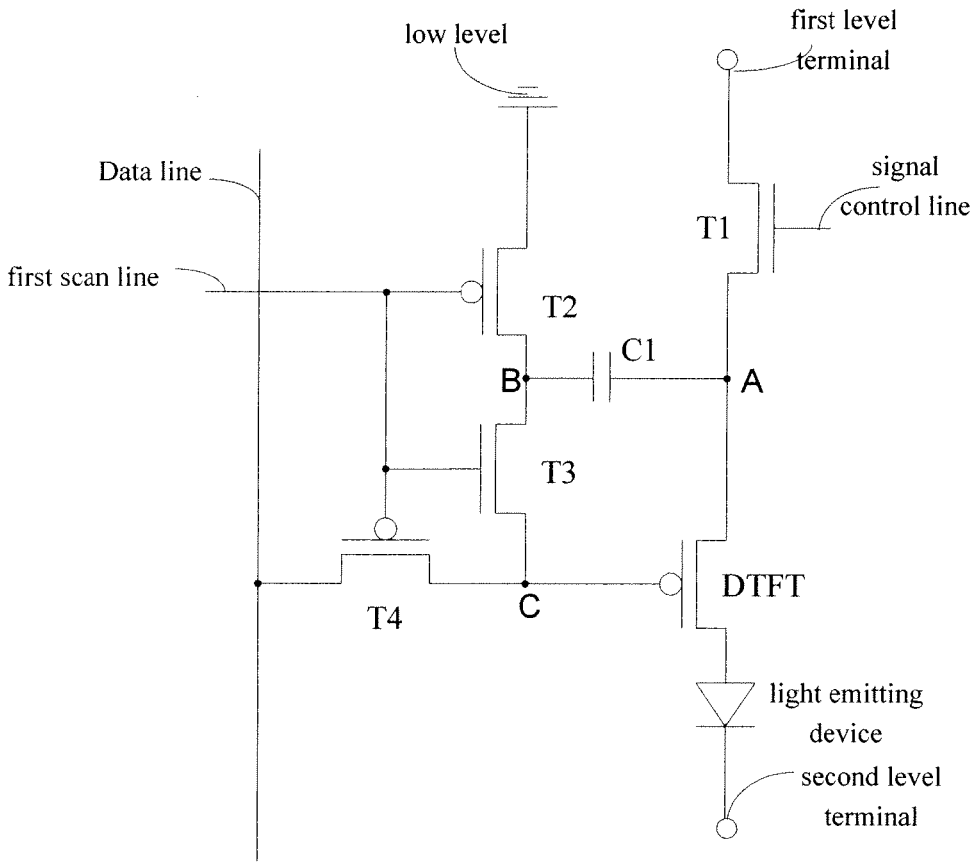
FIG. 2 is a schematic structure diagram of a pixel driving circuit provided in an embodiment of the present disclosure.

FIG. 2 is a pixel driving circuit provided in an embodiment of the present disclosure, which includes a data line, a first scan line, a signal control line, a light emitting device, a storage capacitor C1, a driving transistor DTFT, a first switching transistor T1, a second switching transistor T2, a third switching transistor T3, and a fourth switching transistor T4.

The first switching transistor T1 has a gate connected to the signal control line, a source connected to a first level terminal, and a drain connected to a first terminal of the storage capacitor C1;

the second switching transistor T2 has a gate connected to the first scan line, a source connected to a low level, and a drain connected to a second terminal of the storage capacitor C1;

the third switching transistor T3 has a gate connected to the first scan line, and a source connected to the second terminal of the storage capacitor C1;

the fourth switching transistor T4 has a gate connected to the first scan line, a source connected to the data line, and a drain connected to a drain of the third switching transistor T3;

the driving transistor DTFT has a gate connected to the drain of the fourth switching transistor T4, and a source connected to the first terminal of the storage capacitor C1;

one terminal of the light emitting device is connected to the drain of the driving transistor DTFT, and the other terminal is connected to a second level terminal.

Wherein, the first switching transistor T1 and the third switching transistor T3 are N type switching transistors, and the driving transistor DTFT, the second switching transistor T2 and the fourth switching transistor T4 are P type switching transistors;

Or, the first switching transistor T1, the third switching transistor T3 and the driving transistor DTFT are P type switching transistors, and the second switching transistor T2 and the fourth switching transistor T4 are N type switching transistors.

Of course, the light emitting device may be an Organic light emitting diode OLED, when the OLED is a bottom emitting OLED, the level $V_2$ of the second level terminal is lower than the level $V_1$ of the first level terminal. It is preferable that the low level is a ground terminal. In FIG. 2, the bottom emitting OLED is shown as an example.

With the pixel driving circuit provided in the embodiment of the present disclosure, the influence on the OLED driving current caused by threshold voltage drift of the driving transistor can be removed by voltage compensation, and thus the uniformity of the display image can be improved.

Figure 3:
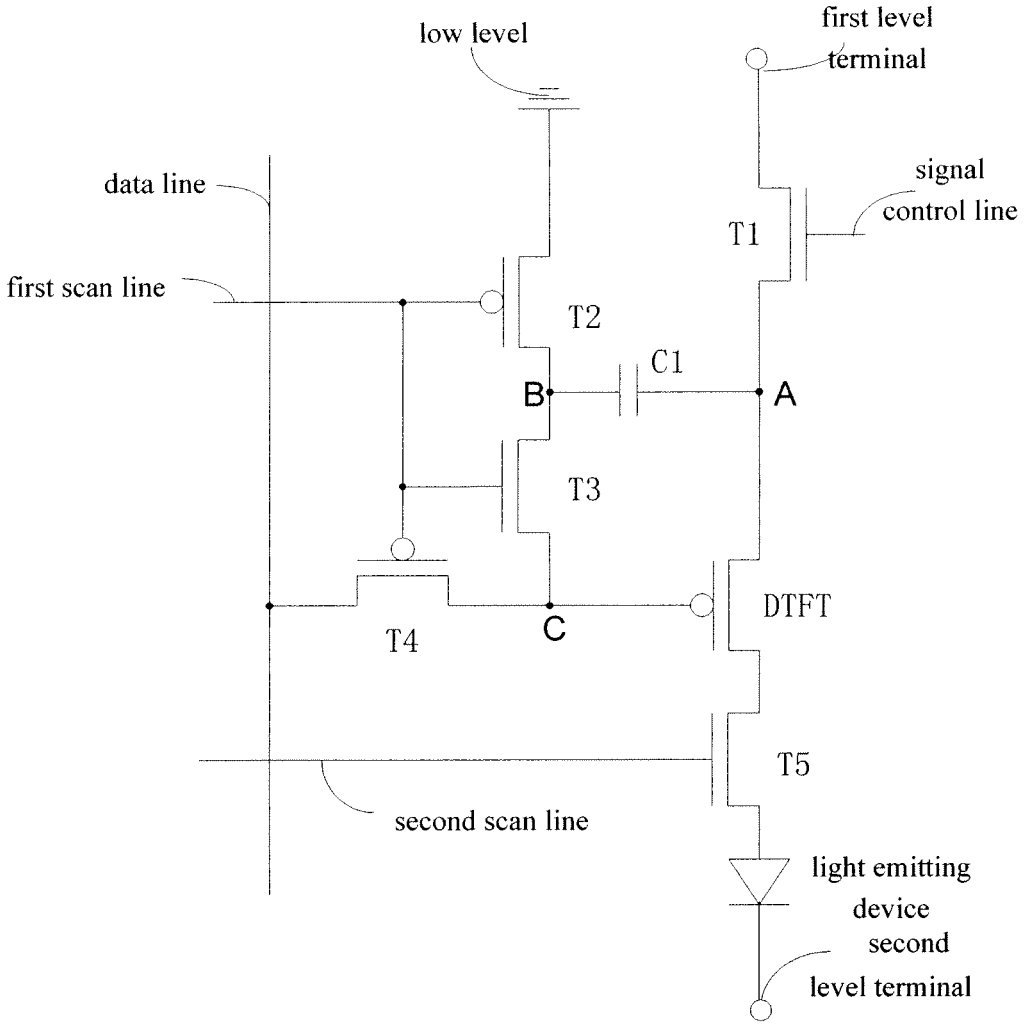
FIG. 3 is a schematic structure diagram of another pixel driving circuit provided in another embodiment of the present disclosure.

Furthermore, as shown in FIG. 3, in addition to the devices comprised in the pixel driving circuit described above, another pixel driving circuit provided in another embodiment of the present disclosure further comprises: a second scan line and a fifth switching transistor T5, wherein the fifth switching transistor T5 has a gate connected to the second scan line, a source connected to the drain of the driving transistor DTFT, and a drain connected to the one terminal of the light emitting device; the other terminal of the light emitting device is connected to the second level terminal.

Similarly, the light emitting device may be an Organic light emitting diode OLED, when the OLED is a bottom emitting OLED, the level $V_2$ of the second level terminal is lower than the level $V_1$ of the first level terminal, when the OLED is a top emitting OLED, the level $V_2$ of the second level terminal is higher than the level $V_1$ of the first level terminal. In FIG. 3, the bottom emitting OLED is shown as an example.

Wherein, the first switching transistor T1 and the third switching transistor T3 are N type switching transistors, and the second switching transistor T2, the fourth switching transistor T4 and the driving transistor DTFT are P type switching transistors;

Or, the first switching transistor T1, the third switching transistor T3 and the driving transistor DTFT are P type switching transistors, and the second switching transistor T2 and the fourth switching transistor T4 are N type switching transistors.

Herein, the fifth switching transistor T5 may be turned off after the display is completed, and thus functions to protect the light emitting device.

With reference to the pixel driving circuits provided in the respective embodiments of the present disclosure, the embodiments of the present disclosure further provide a driving method for the pixel driving circuits in the above embodiments of the present disclosure.

In a first period, the first, second and fourth switching transistors are turned on, the third switching transistor is turned off, and the first level terminal charges the storage capacitor;

in a second period, the second and fourth switching transistors are turned on, the first and third switching transistors are turned off and the storage capacitor discharges till a voltage difference between the gate and source of the driving transistor is equal to a threshold voltage of the driving transistor; and in a third period, the first and third switching transistors are turned on, the second and fourth switching transistors are turned off, and the first level terminal and the second level terminal apply a turn-on signal on the light emitting device.

Furthermore, in the pixel driving circuit comprising the fifth switching transistor and the second scan line, the fifth switching transistor is in a turn-on state from the first period to the third period.

Description will be made with taking the first switching transistor T1 and the third switching transistor T3 being N type switching transistors, the second switching transistor T2, the fourth switching transistor T4 and the driving transistor DTFT being P type switching transistors and the fifth switching transistor T5 being N type switching transistor as an example (the fifth switching transistor T5 may be either P type or N type switching transistor). With reference to the schematic state diagram showing signal timings of the pixel driving circuits provided in FIG. 4, together with the schematic state diagrams showing equivalent circuits of the pixel driving circuits during respective periods provided in FIG. 5*a*~5*c*, description will be given for the driving method for the pixel driving circuit provided in the embodiment of the present disclosure as follows.

Figure 4:
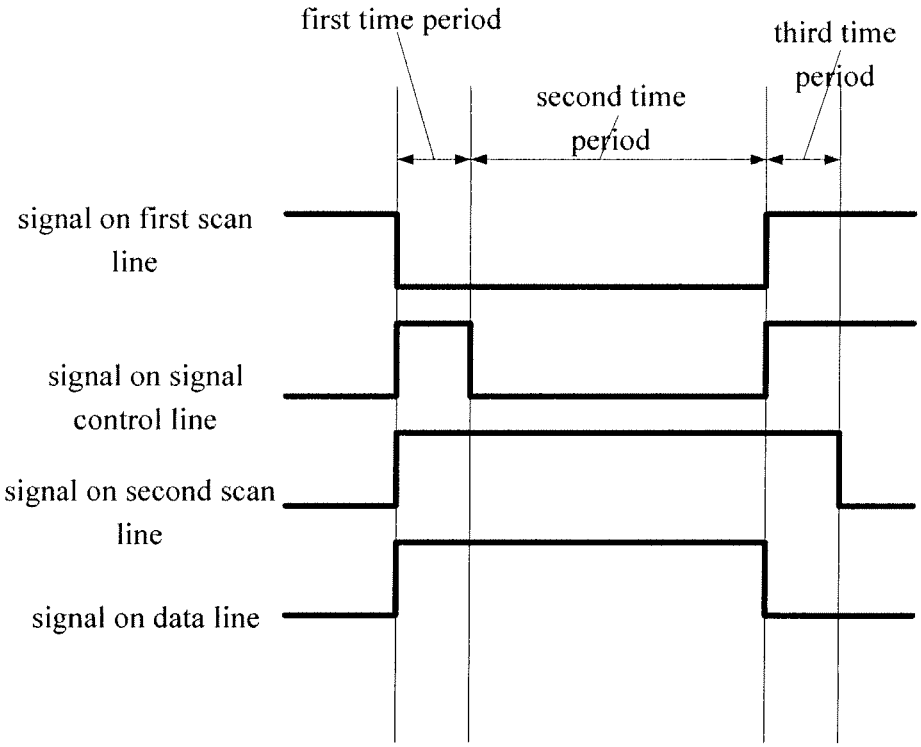
FIG. 4 is a schematic state diagram showing signal timings of the pixel driving circuits provided in the embodiments of the present disclosure.
Figure 5A:
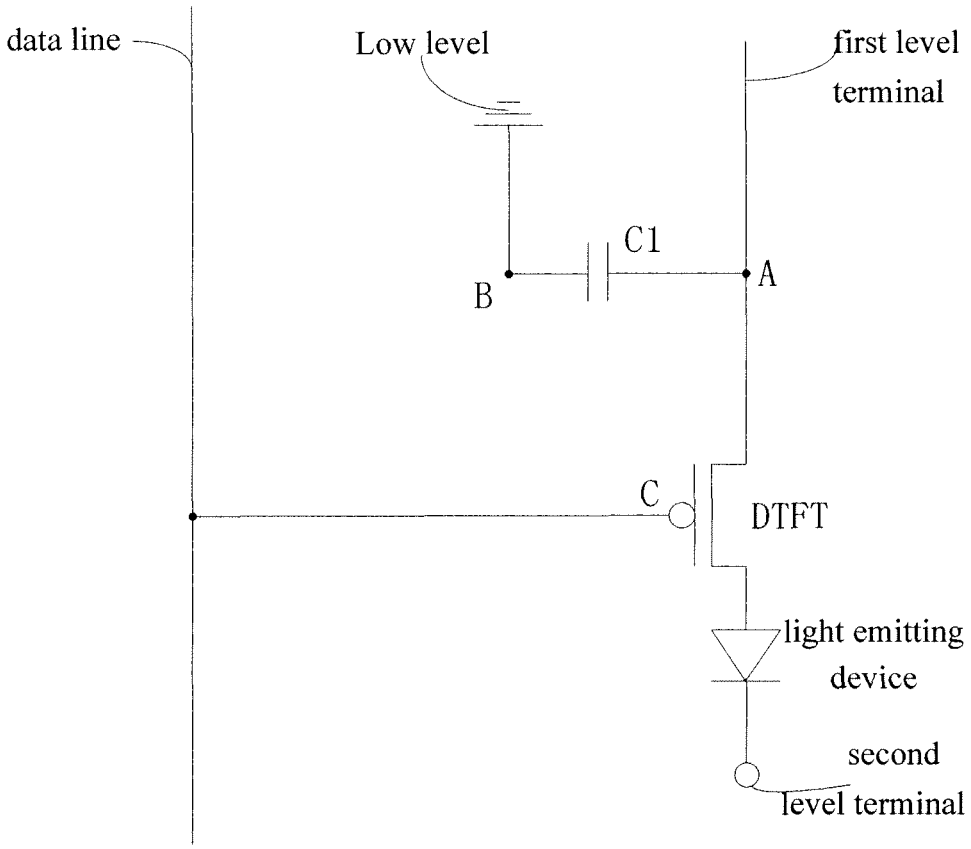
FIG. 5*a* is a schematic diagram of an equivalent circuit of the pixel driving circuits provided in the embodiments of the present disclosure during a first time period.

In a first period, that is, the first time period in the schematic state diagram of signal timings as shown in FIG. 4, a low level signal is applied to the first scan line, and a high level signal is applied to the second scan line, the signal control line and the data line, the first switching transistor T1, the second switching transistor T2, the fourth switching transistor T4, and the fifth switching transistor T5 are turned on, the third switching transistor T3 is turned off and the first level terminal charges the storage capacitor C1. The equivalent circuit formed at this time is as shown in FIG. 5*a*. During this period, voltage at the first terminal of the storage capacitor C1 (that is, point A in FIG. 5*a*) is charged to be equal to the voltage at the first level terminal, the voltage $V_A$ at point A is equal to the voltage $V_1$ at the first level terminal at this time; in addition, the second terminal of the storage capacitor C1 is connected to the low level, that is, voltage $V_B$ at the second terminal (that is, point B in FIG. 5*a*) equals 0.

Figure 5B:
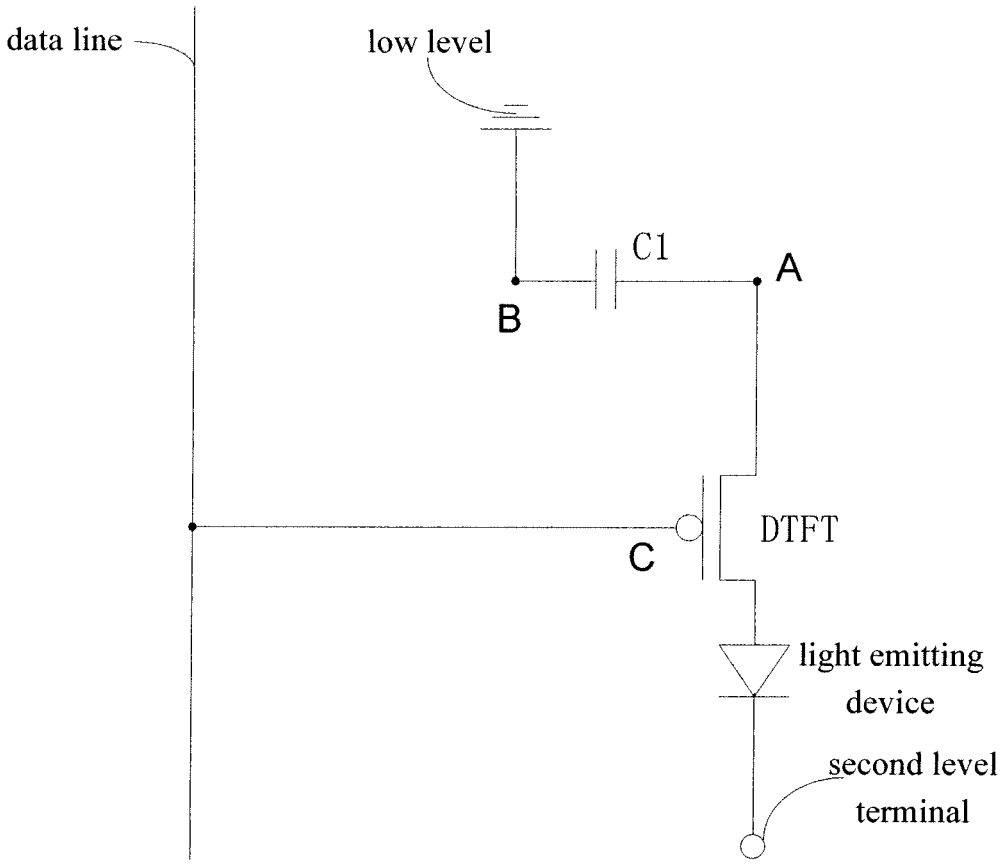
FIG. 5*b* is a schematic diagram of an equivalent circuit of the pixel driving circuits provided in the embodiments of the present disclosure during a second time period.

In a second period, that is, the second time period in the schematic state diagram of signal timings as shown in FIG. 4, the low level signal is applied to the first scan line and the signal control line, and the high level signal is applied to the second scan line and the data line, the second switching transistor T2, the fourth switching transistor T4 and the fifth switching transistor T5 are turned on, the first switching transistor T1 and the third switching transistor T3 are turned off, and the storage capacitor C1 discharges till a voltage difference between the gate and source of the driving transistor DTFT is equal to a threshold voltage of the driving transistor DTFT. The equivalent circuit formed at this time is as shown in FIG. 5*b*. During this period, voltage at the first terminal of the storage capacitor C1 (that is, point A in FIG. 5*b*) begins to discharge till $V_A-V_C=V_{th}$ wherein $V_A$ is the voltage at point A, $V_C$ is the voltage at point C, that is, the voltage at the gate of the driving transistor DTFT, at this time, $V_C=V_{data}$, wherein $V_{data}$ is a voltage value supplied from the data line, $V_{th}$ is the threshold voltage of the driving transistor DTFT. At last, the voltage at point A becomes $V_{data}+V_{th}$. Such a period is a compensation period, and also providing a buffering effect for preparing for a next period.

Figure 5C:
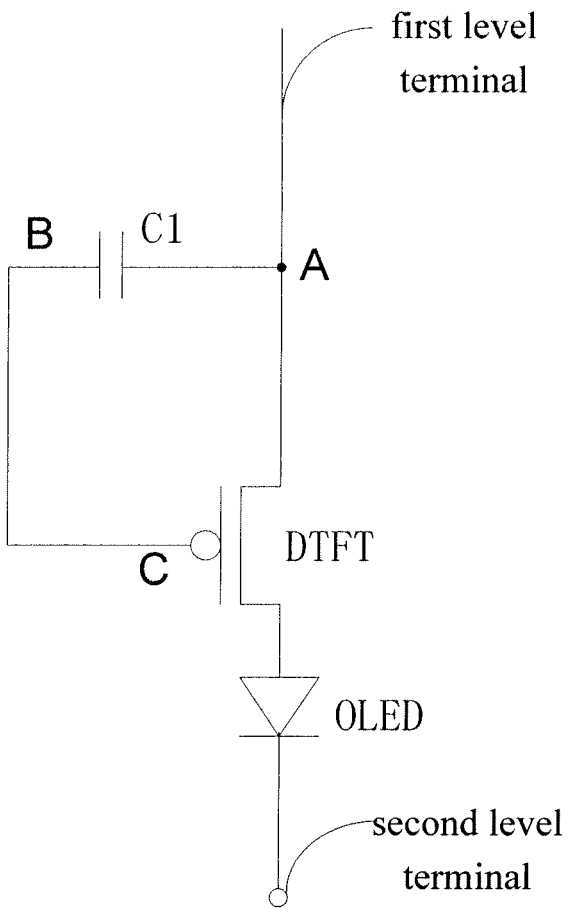
FIG. 5*c* is a schematic diagram of an equivalent circuit of the pixel driving circuits provided in the embodiments of the present disclosure during a third time period.

In a third period, that is, the third time period in the schematic state diagram of signal timings shown in FIG. 4, the high level signal is applied to the first scan line, the second scan line and the signal control line, and the low level signal is applied to the data line, the first switching transistor T1, third switching transistor T3 and the fifth switching transistor T5 are turned on, the second switching transistor T2 and the fourth switching transistor T4 are turned off, and the first level terminal and the second level terminal apply a turn-on signal on the light emitting device. The equivalent circuit formed at this time is as shown in FIG. 5*c*. During this period, the voltage at the first terminal of the storage capacitor C1 returns to the same voltage value $V_1$ as that of the first level terminal, the second terminal of the storage capacitor C1 is floating, and the voltage at the first terminal and the voltage at the second terminal change by a same amount, that is, $V_B=V_C=V_1-V_{data}-_{th}$, the organic light emitting device starts to emit light, wherein a driving current can be calculated as:

$$I_{OLED}=K[V_{GS}-V_{th}]^2=K[V_1-(V_1-V_{data}-V_{th})-V_{th}]^2=K\cdot V_{data}^2.$$

It can be seen that the driving current $I_{OLED}$ only has relation to the voltage $V_{data}$ at the data line, and thus will not be affected by $V_{th}$, wherein $V_{GS}$ is the voltage between the gate and the source of TFT, $$K=\frac{1}{2}\mu C_{ox}\frac{W}{L},$$

wherein μ and $C_{ox}$ are process constants, W is the TFT channel width, L is the TFT channel length, and W and L are constants designed selectively.

The above description is given assuming that the light emitting device adopts bottom emitting OLED, that is, the level of the first level terminal is higher than the level of the second level terminal. In addition, it may be understood that the second terminal may be directly connected to the low level when the light emitting device adopts a bottom emitting OLED, that is, a negative terminal of the OLED is connected to the low level, whereby reducing the difficulty of designing the pixel driving circuit and making the construction of the circuit more convenient.

Figure 6:
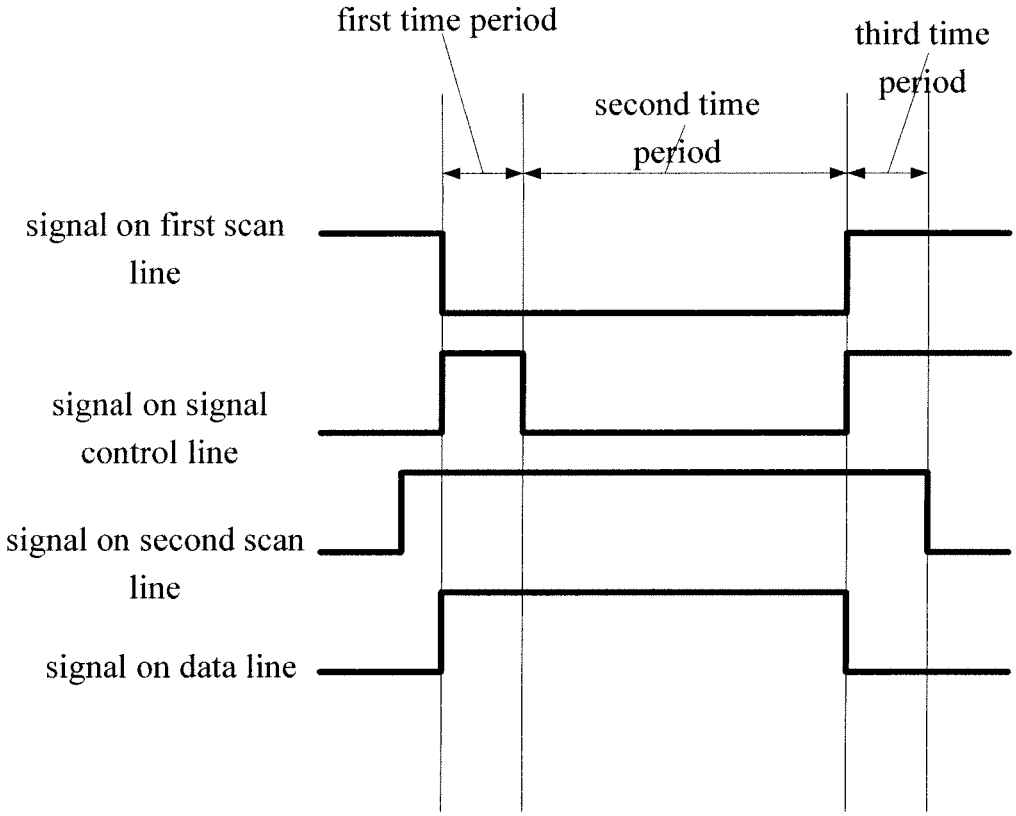
FIG. 6 is a schematic state diagram showing another signal timings of the pixel driving circuits provided in the embodiments of the present disclosure.

Furthermore, with reference to the timing state diagram as shown in FIG. 6, before the first period begins, the high level signal is applied to the second scan line, and the fifth switching transistor is turned on in advance since the second scan line is applied to the level signal (here, the high level) in advance. In this case, the driving circuit enters into a preparation state in advance before the driving transistor DTFT operates, and thus residual current inside the circuit can be consumed to reduce the appearance of afterimage phenomenon in the displayed image. In addition, the fifth switching transistor T5 may turns off after the display is completed, and thus functions to protect the light emitting device.

The above embodiments are described assuming the first switching transistor T1 and the third switching transistor T3 are N type switching transistors, the second switching transistor T2, the fourth switching transistor T4 and the driving transistor DTFT are P type switching transistors. Of course, the first switching transistor T1, the third switching transistor T3 and the driving transistor DTFT may be P type switching transistors, and the second switching transistor T2 and the fourth switching transistor T4 may be N type switching transistors, and under such a circumstance, it is necessary to adjust the level signals applied to the first scan line, the second scan line, the signal control line and the data line. That is to say, in the embodiments of the present disclosure, there is no limitation on types of the respective switching transistors and the driving transistor, that is, when types of the respective switching transistors and the driving transistor are changed, simply adjust the level signals applied to the first scan line, the second scan line, the signal control line and the data line. Here, any combination that can be easily thought of and obtained by those skilled in the art based on the pixel driving circuit and driving method provided in the embodiments of the present disclosure should be included in the protection scope of the present disclosure, as long as the driving method for the pixel driving circuit provided in the embodiment of the present disclosure can be achieved.

With the driving method for the pixel driving circuit provided in the embodiment of the present disclosure, the influence on the OLED driving current caused by threshold voltage drift of a driving transistor can be removed by voltage compensation and thus the uniformity of the display image can be improved.

In yet another embodiment of the present disclosure, there is provided an array substrate comprising: a plurality of data lines extended and arranged along columns of the array; a plurality of first scan lines, second scan lines and signal control lines extended and arranged along rows of the array; a plurality of pixels arranged at intersections of the plurality of data lines and the plurality of first scan lines or second scan lines in a matrix form; wherein each of the pixels comprises any of the above described pixel driving circuits.

With the array substrate provided in the embodiment of the present disclosure, the influence on the OLED driving current caused by threshold voltage drift of a driving transistor can be avoided by voltage compensation and thus the uniformity of the display image can be improved.

In still another embodiment of the present disclosure, there is provided a display apparatus comprising the above described array substrate. In addition, the display apparatus can be display devices such as electronic paper, mobile phone, television, digital frame, etc.

With the display apparatus provided in the embodiment of the present disclosure, the influence on the OLED driving current caused by threshold voltage drift of a driving transistor can be removed by voltage compensation and thus the uniformity of the display image can be improved.

The above descriptions are only for illustrating the embodiments of the present disclosure, and in no way limit the scope of the present disclosure. It will be obvious that those skilled in the art may make modifications, variations and equivalences to the above embodiments without departing the spirit and scope of the present disclosure as defined by the following claims. Such variations and modifications are intended to be included within the spirit and scope of the present disclosure.

What is claimed is:

1. A pixel driving circuit, comprising: a data line, a first scan line, a signal control line, a light emitting device, a storage capacitor, a driving transistor, a first switching transistor, a second switching transistor, a third switching transistor, and a fourth switching transistor;

the first switching transistor having a gate connected to the signal control line, a source connected to a first level terminal, and a drain connected to a first terminal of the storage capacitor;

a gate of the second switching transistor, a gate of the third switching transistor and a gate of the fourth switching transistor being connected to the first scan line, and being controlled by a same signal from the first scan line;

the second switching transistor having a source connected to a low level, and a drain connected to a second terminal of the storage capacitor;

the third switching transistor having a source connected to the second terminal of the storage capacitor;

the fourth switching transistor having, a source connected to the data line, and a drain connected to a drain of the third switching transistor;

the driving transistor having a gate connected to the drain of the fourth switching transistor, and a source connected to the first terminal of the storage capacitor;

one terminal of the light emitting device being connected to the drain of the driving transistor, and other terminal being connected to a second level terminal.

2. The pixel driving circuit of claim 1, wherein the one terminal of the light emitting device is directly connected to the drain of the driving transistor.

3. The pixel driving circuit of claim 2, wherein the first switching transistor and the third switching transistor are N type switching transistors, and the second switching transistor, the fourth switching transistor and the driving transistor are P type switching transistors.

4. The pixel driving circuit of claim 2, wherein the first switching transistor, the third switching transistor and the driving transistor are P type switching transistors, and the second switching transistor and the fourth switching transistor are N type switching transistors.

5. The pixel driving circuit of claim 1, further comprising: a second scan line and a fifth switching transistor, the one terminal of the light emitting device being connected to the drain of the driving transistor via the fifth switching transistor, wherein the fifth switching transistor has a gate connected to the second scan line, a source connected to the drain of the driving transistor, and a drain connected to the one terminal of the light emitting device.

6. The pixel driving circuit of claim 5, wherein the fifth switching transistor is an N type switching transistor or a P type switching transistor.

7. The pixel driving circuit of claim 1, wherein the first switching transistor and the third switching transistor are N type switching transistors, and the second switching transistor, the fourth switching transistor and the driving transistor are P type switching transistors.

8. The pixel driving circuit of claim 1, wherein the first switching transistor, the third switching transistor and the driving transistor are P type switching transistors, and the second switching transistor and the fourth switching transistor are N type switching transistors.

9. A driving method for the pixel driving circuit of claim 1, comprising:

in a first period, turning on the first switching transistor, the second switching transistor and the fourth switching transistor, turning off the third switching transistor, and the first level terminal charging the storage capacitor;

in a second period, turning on the second switching transistor and the fourth switching transistor, turning off the first switching transistor and the third switching transistor, and the storage capacitor discharging till a voltage difference between the gate and source of the driving transistor is equal to a threshold voltage of the driving transistor; and in a third period, turning on the first switching transistor and the third switching transistor, turning off the second switching transistor and the fourth switching transistor, and the first level terminal and the second level terminal applying a turn-on signal on the light emitting device.

10. The driving method of claim 9, wherein the pixel driving circuit further comprising a second scan line and a fifth switching transistor, the one terminal of the light emitting device being connected to the drain of the driving transistor via the fifth switching transistor, wherein the fifth switching transistor has a gate connected to the second scan line, a source connected to the drain of the driving transistor, and a drain connected to the one terminal of the light emitting device;

wherein the fifth switching transistor is in a turned-on state from the first period to the third period.

11. The driving method of claim 10, wherein the fifth switching transistor is turned on in advance before the first period begins.

12. An array substrate, comprising the pixel driving circuit of claim 1.

13. A display apparatus, comprising the array substrate of claim 12.

* * * * *